US007803019B2

(12) United States Patent
Yen

(10) Patent No.: US 7,803,019 B2
(45) Date of Patent: Sep. 28, 2010

(54) SOCKET STRUCTURE OF CURRENT-RECTIFIABLE LAMP STRING

(76) Inventor: Chun-Chang Yen, No. 8, Lane 247 Nieu Pu Rd., Hsichih City (TW)

( * ) Notice: Subject to any disclaimer, the term of this patent is extended or adjusted under 35 U.S.C. 154(b) by 88 days.

(21) Appl. No.: 12/371,920

(22) Filed: Feb. 17, 2009

(65) Prior Publication Data

US 2010/0210141 A1 Aug. 19, 2010

(51) Int. Cl.
*H01R 13/66* (2006.01)

(52) U.S. Cl. ..... 439/620.01

(58) Field of Classification Search ..... 439/620.01, 439/620.26, 620.3, 620.31, 620.09; 362/224, 362/232, 229; 315/192, 291, 254
See application file for complete search history.

(56) References Cited

U.S. PATENT DOCUMENTS 5,034,846 A * 7/1991 Hodge et al. ..... 361/119
5,938,477 A * 8/1999 Yen ..... 439/620.31
6,190,207 B1 * 2/2001 Wang ..... 439/620.31
6,560,079 B1 * 5/2003 Hirsh et al. ..... 361/42
7,021,968 B1 * 4/2006 Lu ..... 439/620.07
7,221,106 B1 * 5/2007 Nemir et al. ..... 315/291
7,443,056 B2 * 10/2008 Fisher et al. ..... 307/116
7,705,706 B2 * 4/2010 Ding ..... 337/261
2009/0011647 A1 * 1/2009 Lai ..... 439/620.09
2009/0195165 A1 * 8/2009 Yang ..... 315/152
2009/0197470 A1 * 8/2009 Ding ..... 439/620.3

* cited by examiner

*Primary Examiner*—Alexander Gilman
(74) *Attorney, Agent, or Firm*—Leong C. Lei

(57) ABSTRACT

The present invention is to provide a socket structure of current-rectifiable lamp string and especially is aimed at a socket set with rectification diodes. Its features are that one pin of the left and right rectification diodes along with wires inside the socket are clamped on the left and right terminals and the other pins are rivet-assembled with one conductive connector to form a mutually conducting status. It thus can solve the problem of inconvenience in constructing caused by the former welding method.

4 Claims, 5 Drawing Sheets

SOCKET STRUCTURE OF CURRENT-RECTIFIABLE LAMP STRING

PRIOR ART OF THE INVENTION

Due to that the LED (light emitting diode) has the characteristics of lower power consumption, low generating heat and long service life, the former Christmas lamps or other decoration lamps using traditional lamps are gradually replaced by LEDs. However, the LED has the electrical directivity; it will not be lightened once the current direction is reversed. Therefore, it will cause the flickering while 10V or 220V AC (alternative current) are used and it also wastes the electrical energy. Presently, a socket setting additionally with the rectification diode is emerged, the problems of unstable current and voltage are solved through it such that the luminance of lamps in the LED lamp string can be stabilized and the service life can be prolonged. However, two rectification diodes need to be set additionally in the socket, and the ordinary design is using the welding method to weld one pin of the rectification diodes separately with the left and right terminals connect-setting with electrical wires and connect-weld the other pin of the rectification diodes together. However, it not only needs to be processed with care by man while proceeding the welding work, but also the narrow assembling space in the socket causes easily the inconvenience of welding process. It relatively will cause the increase in the manufacturing cost. It is not really ideal and thus waits to be improved.

SUMMARY OF THE INVENTION

The present invention is to provide a socket structure of current-rectifiable lamp string and especially is aimed at a socket set with rectification diodes. Its features are that one pin of the left and right rectification diodes along with wires inside the socket are clamped on the left and right terminals and the other pin are rivet-assembled with one conductive connector to form a mutually conducting status. It thus can solve the problem of inconvenience in constructing caused by the former welding method.

DETAILED DESCRIPTION OF THE PREFERRED EMBODIMENT

Figure 1:
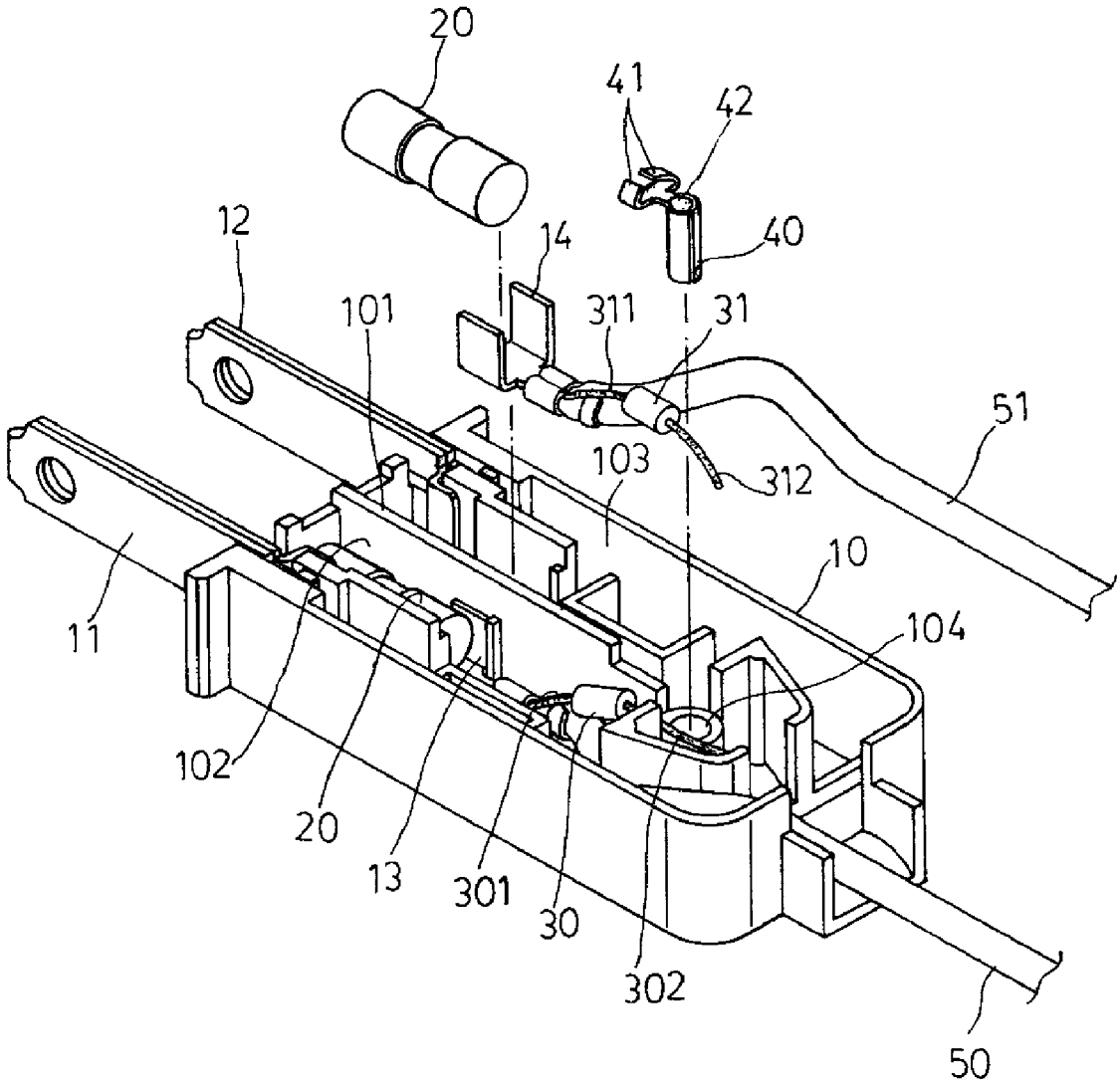
FIG. 1 is a decomposing structural diagram of the present invention while the front plugging socket has two conductive wires.
Figure 2:
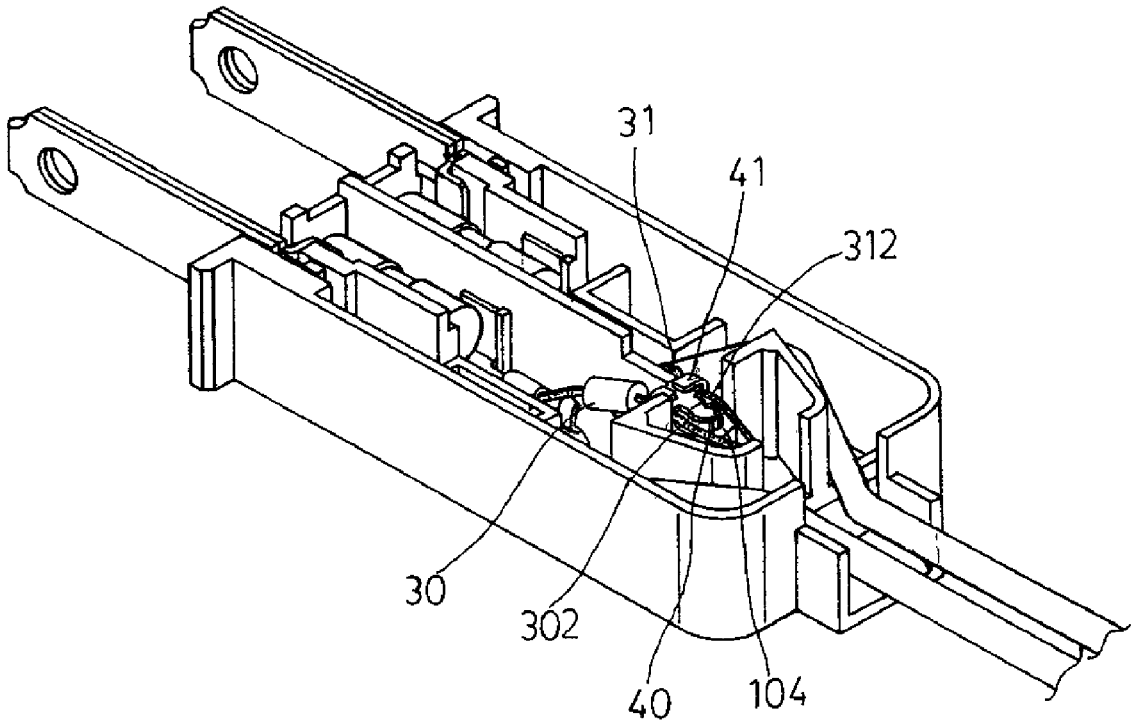
FIG. 2 is a composing diagram of the present invention while the front plugging socket has two conductive wires.

Please firstly refer to those shown in FIGS. 1 and 2, which disclose a structure while the front plugging socket has two conductive wires. It includes a base 10, left, right copper plug pins 11, 12, left, right copper seats 13, 14 connect-setting with wires 50, 51 and fuses 20. The top of said base 10 is hollow, and the left, right compartment 102, 103 are formed by a central partition plate 101. The left, right copper plug pins 11, 12 are laid in the front end of the left, right compartment 102, 103, and the left, right copper seats 13, 14 are laid in the rear end. And, a fuse 20 is laid in between left, right copper plug pins 11, 12 and left, right copper seats 13, 14 to form a conduction. The front plugging socket can be sleeved in with a outer shell (not sown in figures) to form a complete front plugging plug. The feature of present invention is that a housing hole's seat 104 is set on the base 10 face in the end of central partition plate 101. It is further distribute-set with left, right rectification diodes 30, 31 and a conductive connector 40 with its top end set with outward-bent conductive connecting plate 41 having a through hole 42 in the center. The anode (positive pole) end pins 301, 311 of left, right rectification diodes 30, 31 along with electrical wires 50, 51 are separately clamped on the left, right copper seats 13, 14, and the cathode (negative pole) end pins 302, 312 are laid at two sides in the opening of housing hole's seat 104. The conductive connector 40 is then inserting into the housing hole's seat 104, and the outward-bent conductive connecting plate 41 in the top end of conductive connector 40 is rivet-assembled separately with the cathode (negative pole) end pins 302, 312 of the left, right rectification diodes 30, 31 such that the left, right rectification diodes 30, 31 form a conducting status. It thus can solve the problem of inconvenience in constructing caused by adopting the welding method in the prior art.

Figure 3:
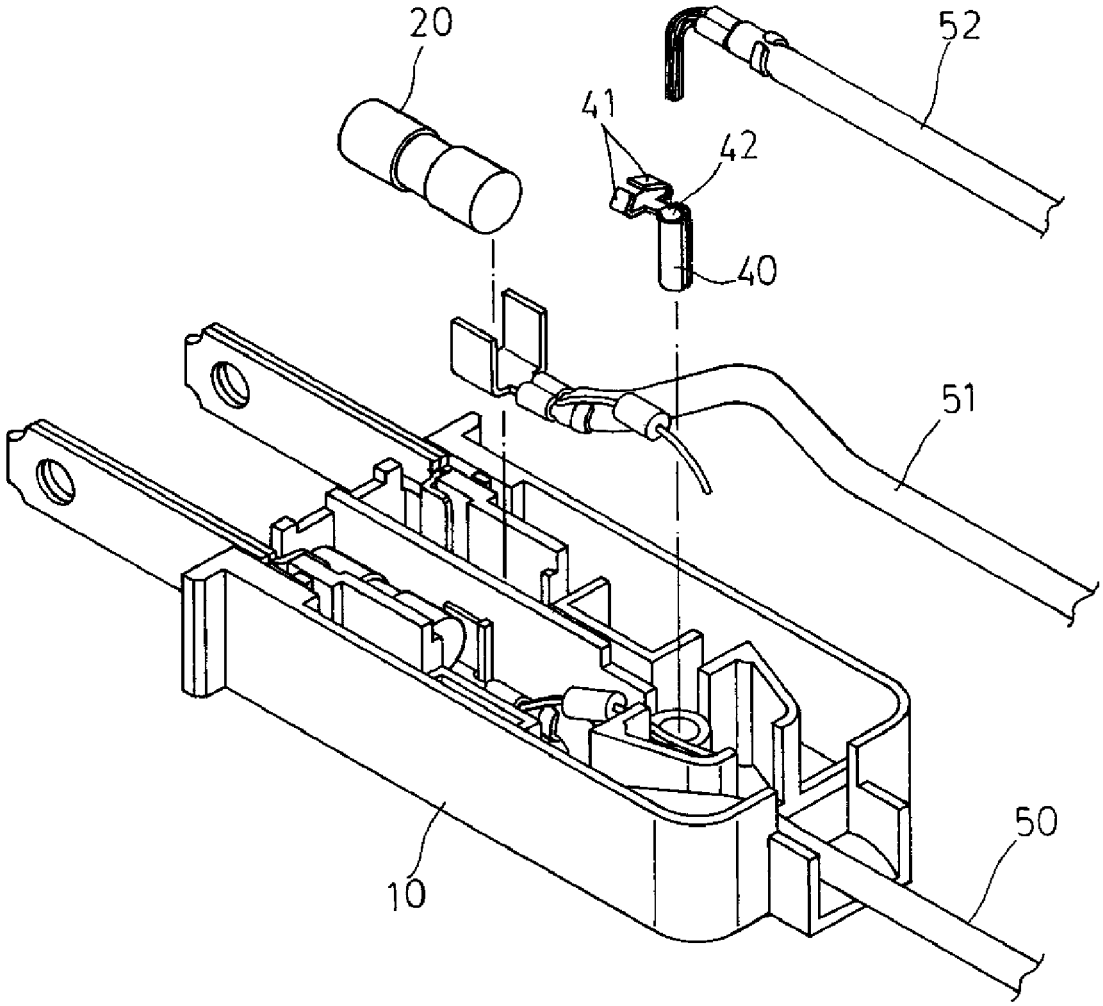
FIG. 3 is a decomposing structural diagram of the present invention while the front plugging socket has three conductive wires.
Figure 4:
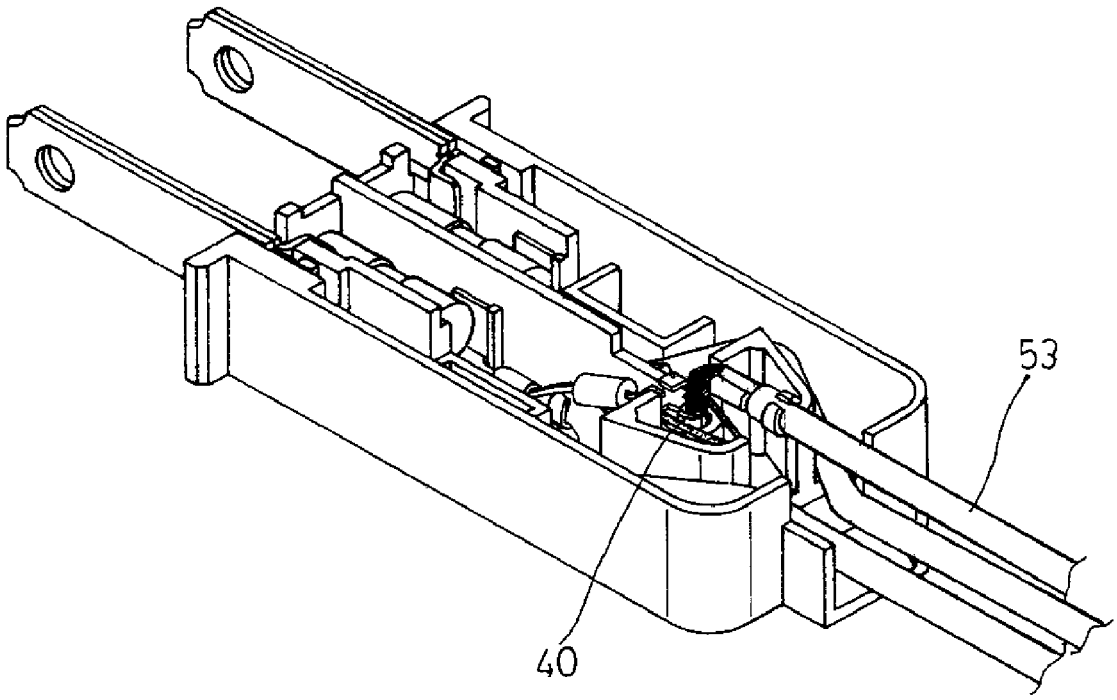
FIG. 4 is a composing diagram of the present invention while the front plugging socket has three conductive wires.

Please refer to FIGS. 3 and 4 that are a structure and assembling method while the front plugging socket has three conductive wires. Its main composing elements and setup method is the same as the front plugging socket with two conductive wires. The different point is there is set with a third electrical wire 52. And, its assembling method is extremely simple. It just requires to insert the copper wire portion in the front end of electrical wire 52 directly into the through hole 42 of conductive connector 40 then the assemble-connecting is completed. After the 110V or 220V AC power is passing through left, right copper plug pins 11, 12 and fuse 20, the AC is rectified by the left, right rectification diodes 30, 31 into DC (direct current) power then provided to the third electrical wire 52. And, the third wire 52 is connected to one or more circuits of LED lamp strings' circuitry.

Figure 5:
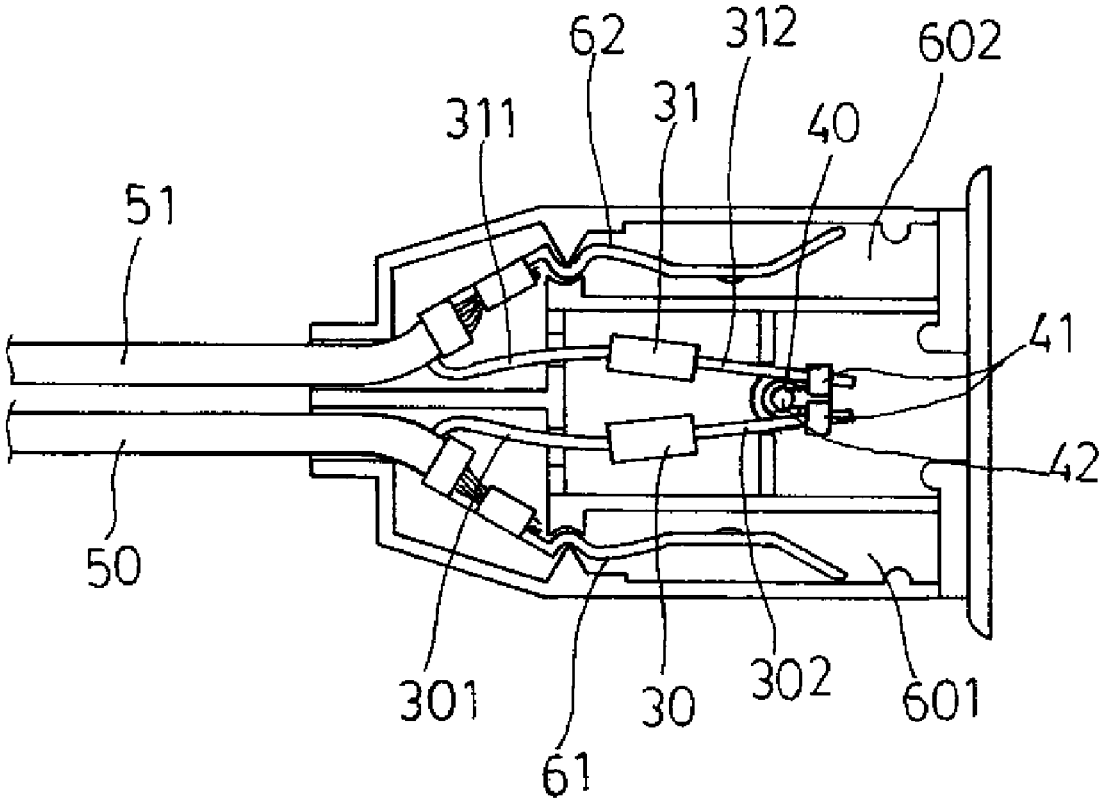
FIG. 5 is a structural plane diagram of a tail-plugging socket in the present invention.

FIG. 5 shows a composing structural diagram of a tail-plugging socket in the present invention while having two conductive wires. It has left, right compartment 601, 602 formed in two sides of a base 60 and has a housing hole's seat 603 set at a site close to the center, and left, right terminal plates 61, 62 set with electrical wires 50, 51 are separately laid in the left, right compartment 601, 602. And, the cathode (negative pole) end pins 301, 311 of left, right rectification diodes 30, 31 along with electrical wires 50, 51 are clamped separately on the left, right terminal plates 61, 62, and anode (positive pole) end pins 302, 312 are laid at two sides in the opening of housing hole's seat 603. The conductive connector 40 is then inserting into the housing hole's seat 603, and the outward-bent conductive connecting plate 41 in the top end of conductive connector 40 is rivet-assembled separately with the one end pins 302, 312 of the left, right rectification diodes 30, 31 such that the left, right rectification diodes 30, 31 form a conducting status. And, while assemble-connecting with a third electrical wire, it also just requires to insert the copper wire portion in the third electrical wire 52 directly into the through hole 42 of conductive connector 40 then the assemble-connecting is completed. Let the third electrical wire of tail-plugging socket and the third electrical wire of front-plugging socket connect together to one or more circuits of LED lamp strings' circuitry. After the DC current of the third electrical wire in the front-plugging socket is passing through the LED lamp string, the DC is transferred into AC by the left, right rectification diodes 30, 31 of tail-plugging socket such that more LED lamp strings can be connect-inserted to this lamp string.

I claim:

1. A socket structure of current-rectifiable lamp string being a structure of front plugging socket with two conductive wires is including a base, left, right copper plug pins, left, right copper seats connect-setting with wires, fuses, left, right rectification diodes and a conductive connector with its top end set with outward-bent conductive connecting plate and having a through hole in the center; the base forms left, right compartment by a central partition plate, the left, right copper plug pins are laid in the front end of the left, right compartment, and the left, right copper seats are laid in the rear end; and, left, right copper plug pins and left, right copper seats are all laid with a fuse in between to form a conduction;

the improvement are that the anode (positive pole) end pins of left, right rectification diodes along with electrical wires are separately clamped on the left, right copper seats, and the cathode (negative pole) end pins are laid at two sides in the opening of housing hole's seat, the conductive connector is then inserting into the housing hole's seat, and the outward-bent conductive connecting plate is rivet-assembled separately with the cathode (negative pole) end pins to form a conducting status.

2. A socket structure of current-rectifiable lamp string according to claim 1, wherein the front-plugging socket is further set with a third electrical wire, and its copper wire portion in the front end of electrical wire is inserted directly into the through hole of conductive connector thus forms a front-plugging socket with three conductive wires.

3. A socket structure of current-rectifiable lamp string according to claim 1, which is further including a socket being a structure of tail-plugging socket with two conductive wires that is a base with left, right compartment formed at two sides in it and a housing hole's seat set at a site close to the center, and left, right terminal plates set with electrical wires are separately laid in the left, right compartment, and the cathode (negative pole) end pins of left, right rectification diodes along with electrical wires are clamped separately on the left, right terminal plates, and anode (positive pole) end pins are laid at two sides in the opening of housing hole's seat, the conductive connector is then inserting into the housing hole's seat, and the outward-bent conductive connecting plate in the top end of conductive connector is rivet-assembled separately with the anode (positive pole) end pins of the left, right rectification diodes such that the left, right rectification diodes form a conducting status.

4. A socket structure of current-rectifiable lamp string according to claim 3, wherein the tail-plugging socket is further set with a third electrical wire, and its copper wire portion in the front end of electrical wire is inserted directly into the through hole of conductive connector thus forms a tail-plugging socket with three conductive wires.

* * * * *